United States Patent [19]

Cohen

[11] 4,050,760

[45] Sept. 27, 1977

[54] SOLDERLESS ELECTRICAL CONTACT

[75] Inventor: Lawrence S. Cohen, Chicago, Ill.

[73] Assignee: TRW Inc., Elk Grove Village, Ill.

[21] Appl. No.: 656,934

[22] Filed: Feb. 10, 1976

[51] Int. Cl.[2] ..... H01R 9/08

[52] U.S. Cl. ..... 339/97 R; 339/223 R

[58] Field of Search ..... 339/96, 97 R, 97 P, 339/98, 99 R, 223 R, 176 M, 176 P, 103 M, 95, 217 R; 174/88 R

[56] References Cited

U.S. PATENT DOCUMENTS

| | | | |
|---|---|---|---|
| 3,145,261 | 8/1964 | Forney, Jr. | 339/98 X |
| 3,867,005 | 2/1975 | Hoppe, Jr. | 339/98 |
| 3,926,498 | 12/1975 | Hoppe, Jr. | 339/97 R |
| 3,950,065 | 4/1976 | Renn | 339/98 |
| 3,990,765 | 11/1976 | Lemesle | 339/97 R |

*Primary Examiner*—Francis S. Husar
*Assistant Examiner*—Mark Rosenbaum
*Attorney, Agent, or Firm*—Neuman, Williams, Anderson & Olson

[57] ABSTRACT

Disclosed is a solderless electrical wire termination system for multi-contact electrical connectors. The termination portion of each contact element is of an elongated U-shaped configuration having a floor and a pair of side walls. Vertically extending ridges are formed inward from the side walls to define termination means for establishing and maintaining electrical connection between the contact element and the conductor of an inserted wire. The upper portions of the ridges are of a configuration providing smoothly tapered lead-in portions for rupturing the insulation of a wire as the wire is inserted into the channel and for guiding the conductive core to the lower portions of the ridges which are of substantially uniform depth and extend substantially parallel to the side walls to provide a rigid wiping surface for establishing and maintaining reliable uniform electrical contact with the conductor core.

9 Claims, 7 Drawing Figures

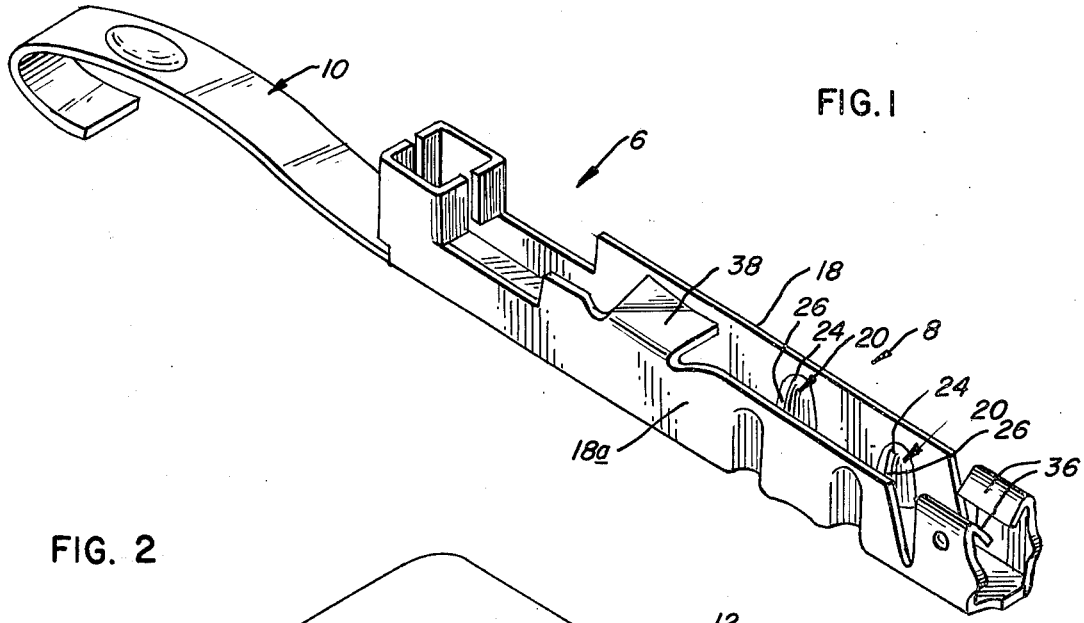
FIG. 1
FIG. 2
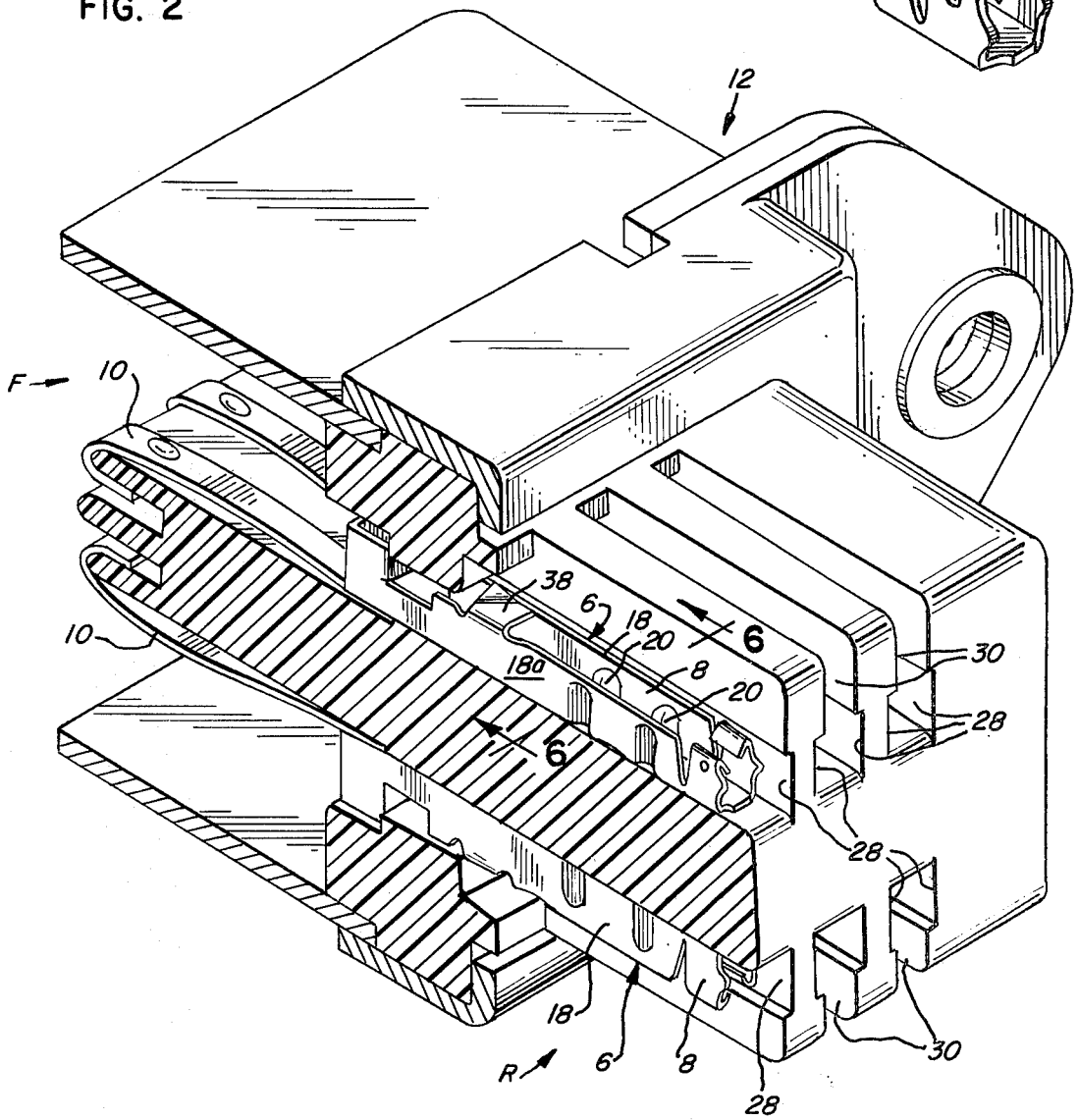

FIG. 3
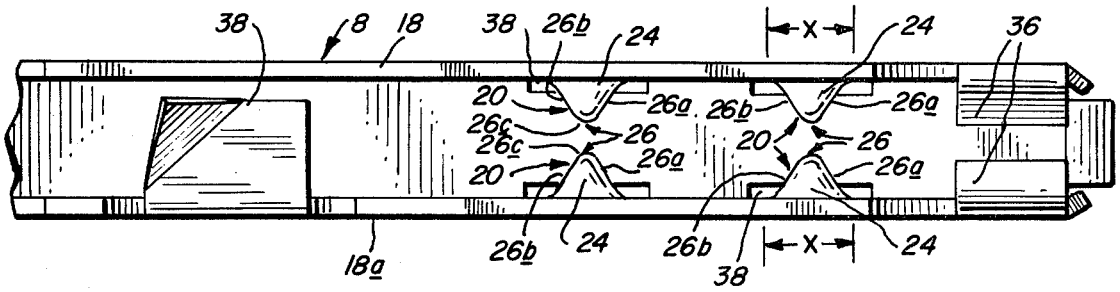
FIG. 4
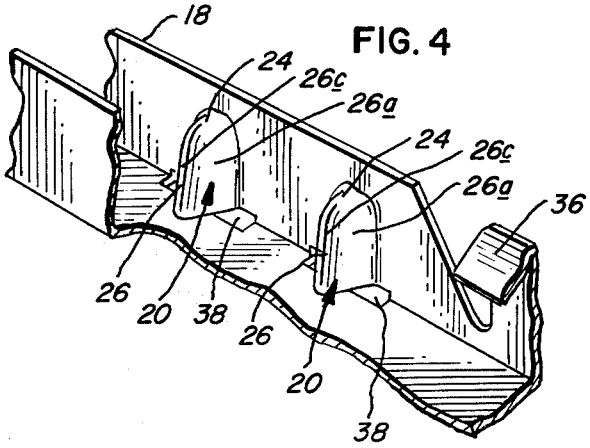
FIG. 5
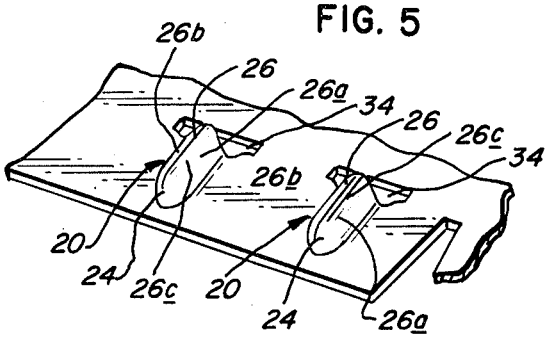
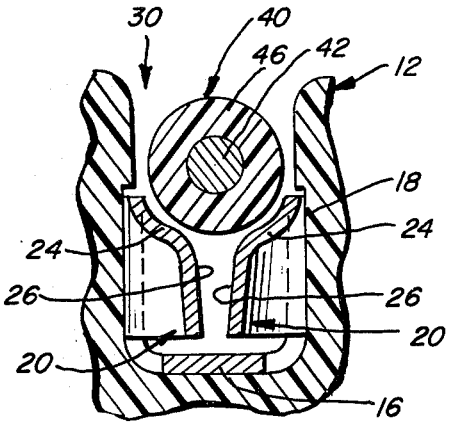
FIG. 6
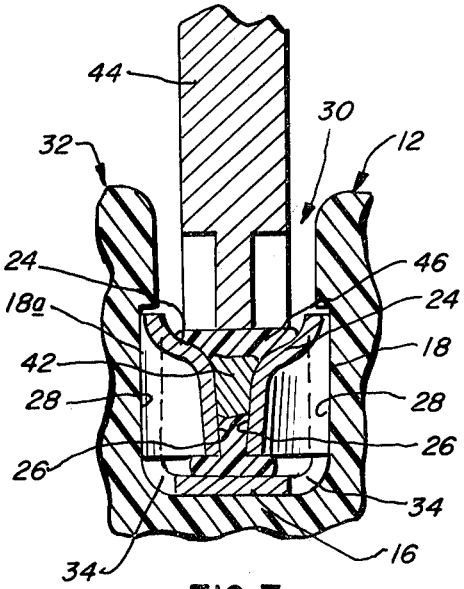
FIG. 7

SOLDERLESS ELECTRICAL CONTACT

This invention relates generally to solderless ribbon connectors and more specifically to wire termination systems in which a wire is engaged and held within a channel-shaped portion of a contact by use of jaws or ridges protruding into the channel with the capability to rupture or separate insulation covering the conductor.

Solderless wire termination systems are widely used in commercial connectors in high density wiring applications. A single connector of this type often includes fifty or more contact elements while, at the same time, being of substantially miniature physical size. Such connectors find use and acceptance in telecommunication and computer applications. In such applications, certain severe design parameters must be met. For example, contact resistance must be minimized and must remain quite constant over long periods of time and under a broad range of environmental conditions. Further, it is desirable that the system provide universal termination capabilities in that the system should perform satisfactorily with wires having conductors of various sizes and types, i.e., both solid core and stranded core wires. Also, ruggedness and strength of the contact and economy of production should be maintained.

It is an object of this invention to provide an improved wire termination system, and particularly to provide an improved wire termination contact element, which meet the aforestated parameters and requirements.

Several systems have heretofore been advanced which include channel-like wires in each channel between jaw-like members. For example, the co-pending application of William McKee and Roy Witte, Ser. No. 443,678 discloses a termination contact design incorporating side walls with integral jaw portions which are formed inward to provide rigid contact jaws. Commercial connectors of that type as well as other designs which have been proposed heretofore have presented an upper cutting edge for interrupting and spreading the insulation of inserted wires, with subjacent ridges extending into the channel to provide electrical contact with the core of the wire. Another approach is shown in the co-pending application of William McKee, Ser. No. 656,866, filed concurrently herewith, which discloses jaws formed from tabs bent from the free or upper edge of the channel side walls into the channel. The latter McKee design provides a rounded lead-in at the channel entry end of each contact ridge for rupturing and spreading insulation either on stranded or solid wires inserted into the channel. This latter design specifically takes cognizance of the fact that the insulation on many commonly used wire types can be readily ruptured and separated from the conductor core without the necessity of sharp cutting edges at the entrance to the channel.

The termination system of the present invention encompasses all of the advantages of the aforesaid connector designs. It exhibits the desirable characteristics obtained with a blunt smooth arcuate lead-in portion and provides high structural rigidity and high contact pressure for effecting reliable uniform electrical contacts. The blunt lead-in portion effectively separates the insulation from inserted conductor cores while avoiding serious cutting or routing of the conductor or, in the case of stranded wire, the severance of outer strands. High structural rigidity and contact pressure ensures gas-tight deep-impression contact interfaces for long life of the connection and low contact resistance through considerable change in environmental conditions. The present design is a further advancement in that the contact elements are capable of being easily manufactured with a minimal amount of metal waste.

The termination system of the present invention is characterized by a generally U-shaped channel portion of each contact similar to that shown for earlier designs. The channel portion has one or more ridges formed inwardly from one or both side walls. In a preferred embodiment, these ridges are formed in pairs, one ridge in each side wall, positioned in the respective side walls in opposing relation. Each ridge has a smoothly rounded blunt lead-in portion and a blunt nose for forcing the insulation away from the conductor and for deforming the conductor at the contact interface. Thus a wire termination channel is formed which exhibits a gradual and smooth lead-in integral with a vertical ridge and which provides the strength and rigidity of jaws formed from and remaining integral with the side walls.

Additional objects and features of the present invention will become apparent from the following detailed discussion of an exemplary embodiment, and from the drawings, in which:

FIG. 1 is a perspective view of a contact member employing teachings of the present invention;

FIG. 2 is a perspective view, particially cut away, of a multi-contact ribbon connector incorporating a plurality of contact members as in FIG. 1;

FIG. 3 is an enlarged top view of the terminating portion of the contact member of FIG. 1;

FIG. 4 is an enlarged partial perspective view of the contact member of FIG. 1;

FIG. 5 is a perspective view, partially cut away, of the jaws of one side of a contact member as they may be formed in a flat blank prior to the final forming of a contact member as in FIG. 1;

FIG. 6 is a sectional view taken along line 6—6 of FIG. 2, showing an insulated wire positioned for insertion; and FIG. 7 is a sectional view similar to FIG. 6 showing an insulated wire being inserted.

Turning first to FIG. 1, there is shown an electrical contact 6 with a mating portion 10 and a wire termination portion 8. The mating portion 10 is designed for face-to-face mating contact with a corresponding contact element of another connector. The termination portion 8 is designed for solderless connection of a wire, as discussed below. By mounting a plurality of the contact members 6 within an insulator housing, a multi-contact connector is formed. FIG. 2 shows a portion of a high density male multi-contact version of one such connector 12 of the type currently sold by TRW Inc. of Elk Grove Village, Ill., under the name CINCH RIBBON. Each such connector has a forward end F for mating engagement with the corresponding complementary portion of another connector, and a wire-receiving or terminating rearward end R. Connection of sets or cables of wires typically is accomplished by connecting one set to the rearward end R of such a male connector and connecting another set to the corresponding end of a similarly constructed female connector, and then mechanically coupling the complementary mating ends of those connectors.

The wire-receiving end 8 of the contact element 6 includes a floor 16 and side walls **18, 18*a* forming an elongated open channel portion. Jaws 20 are formed inwardly from the side walls to provide narrowed constrictions in the channel for engaging wires inserted laterally into the channel. The jaws 20 preferably are formed from the opposite side walls in opposed pairs aligned with one another transversely of the channel. In the illustrated preferred embodiment two such pairs of jaws are provided in the opposing side walls to cooperatively form two contact constrictions in the channel. Each such pair of jaws affords opposing working surfaces 24–26** for establishing and maintaining electrical contact with the conductive core of an inserted wire.

Contacts 6 are formed of thin sheet metal of an appropriate conductive material, e.g., a cadmium bronze alloy on the order of 0.006 inches thickness. Each jaw 20 is formed from the respective side wall by deforming the metal to produce a relatively smooth and continuous ridge extending from near the upper edge of the respective channel wall to the bottom wall 16. For facilitating the insertion of of wires and insuring electrical contact therewith, each of the jaws is provided with a rounded upper lead-in portion 24 which, with the corresponding portion of the opposed jaw, defines a gradually narrowing lead-in area to the constricted area between the opposed jaw contact surfaces 26.

The smooth rounded configuration of the upper end portion 24 provides a reinforced nose for rupturing the insulation on an inserted wire as the wire is forced between the jaw faces 26. The configuration of each jaw and the continuity of the metal of each jaw with the respective side wall along the upper and side edges insure rigidity of the jaw against the forces which result from insertion of a wire and from strain on a wire after insertion.

As best seen in FIG. 3, the main body of the jaw ridge portion providing each surface 26 is of a generally triangular cross section, comprising substantially planar walls **26*a* and 26*b* joined by a rounded inner nose portion 26*c* and each merging unitarily into the respective side wall 18 at its outer end. The configuration of the ridges preferably provides a relatively narrow base dimension between the outer ends of the ridge walls (indicated at "X" in FIG. 3). These outer ends represent the lines of the abutment support for the respective jaw by the walls 28 of a recess 30 in an insulation housing 32 of a connector in which the contact is installed (see FIGS. 2, 6 and 7). Maintaining a narrow base "X" and substantially planar walls 26*a* and 26*b*, along with the integral joinder to the side wall 18, insures both high lateral compressive bearing capacity of the jaws when a wire conductor is forced therebetween and high resistance to bending collapse longitudinally of the channel. These qualities insure that the jaws will withstand high contact pressure between a conductor and the jaw surfaces 26** and high bending moments longitudinal of the channel despite the very thin fragile nature of the sheet material from which the contact is formed.

The jaws may be formed by any suitable forming procedure. One example for their formation is by a die forming process in which the metal is stretched, drawn and bent in a series of progressive steps, as in a progressive die. By way of a further example, the jaws may be formed in a flat blank, as illustrated in FIG. 5, prior to final formation of the blank into the channel configuration of FIG. 1. The blank may be slotted, as at 34, to facilitate the formation of the jaws.

Strain relief tabs 36 may be provided at the outer end of terminal section 8 and a locking tab 38 may be provided at the inner end, in a manner previously known in the aforementioned commercial connectors.

Referring now particularly to FIGS. 6 and 7, each contact 6 typically is installed in a channel-shaped recess 30 in the insulator housing of a connector 12. The side panels 18 and **18*a* are closely adjacent to or preferably in abutment contact with the insulator walls 28. The inner surfaces 26 of the jaws are spaced apart a distance substantially less than the diameter of the conductor core 42 of a wire 40 to be terminated in the contact. Insertion of a wire 40 into the jaw area of the contact to effect a termination normally is accomplished by forcing the wire inward through the passage 30 and from the position of FIG. 6 inward into the channel portion of terminal section 8 until the wire is firmly bottomed against wall 16 with the conductor core 42 jammed between the surfaces 26 of the opposed jaws 20 as in FIG. 7. This insertion may be accomplished by a tool or machine having an appropriate insertion blade 44 as shown above the wire in FIG. 7 and having an end surface to force each wire between a set of the jaws 20.** If a plurality of wires are to be inserted substantially simultaneously, the tool may comprise a plurality of such blades.

As the wire is forced downward between the jaws 20, the insulation 46 is ruptured by the upper ends of the jaws and is stripped or peeled away from the adjacent portion of the conductor core 42. This portion of the core then is forced between the working faces 26 and engages those faces with substantial force to obtain reliable electrical contact between the conductor and the terminal. The surfaces 24–26 forcibly deform the intervening conductor and form indentations in the sides of the conductor, as indicated in FIG. 7. However, due to the rounded shape of the formed noses 24, the possibility of cutting or severing the inserted conductor is minimized.

By way of one specific example, contacts 6 may be formed of the aforementioned sheet metal with the channels of terminal portion 8 about 0.05 inch wide for mounting in rows in a connector 12 with the contacts on about 0.085 inch centers. The opposed pairs of jaws may be formed inward to provide a space between the upper portions of surfaces 26 of about 0.006 inch or less for terminating 24 ga. or 26 ga. solid core wire or 28 ga. stranded core wire. These surfaces also preferably are tapered slightly toward one another as shown in FIGS. 6 and 7.

While a wire 40 having a solid core is illustrated for descriptive purposes in FIGS. 6 and 7, the illustrated contact is of universal applicability in that it also may be used to form comparable connections with wires having stranded conductor cores by the same manner of insertion. The configuration and rigidity of the jaws also permit termination of wires having conductor cores of a variety of diametral sizes in contacts of the same dimensions.

From the foregoing it is apparent that there has been brought to the art an improved electrical contact design which meets the aforestated requirements and objects. This contact provides a high degree of structural rigidity to resist lateral compressive forces and longitudinal forces, while at the same time providing the capability of separating the insulation from both stranded and solid wires without risk of damaging the underlying conductor.

While a particular embodiment of the present invention has been shown, it will be understood, of course, that the invention is not limited thereto since modifications may be made by those skilled in the art, particularly in light of the foregoing teachings. It is, therefore, contemplated by the appended claims to cover any such modifications as incorporate those features which come within the true spirit and scope of the invention.

I claim:

1. An insulation rupturing wire termination contact element for establishing and maintaining electrical contact with the conductive core of an insulated wire as the insulated wire is forced into the contact element, comprising a wire termination channel portion having side panels and a base portion of thin conductive sheet metal, at least one of said side panels having an integral offset portion formed inwardly into said channel to engage the conductive core of a wire inserted therein, said offset portion having an end exposed toward the open side of said channel which end is formed by bending said sheet metal into a smoothly rounded blunt transitional configuration having sufficient rigidity for rupturing the insulation of a wire forced into said wire termination channel and for guiding the conductive core of such a wire into contact with the inwardly disposed surface of said offset portion.

2. The wire termination contact of claim 1 wherein said offset comprises a deformation of said side panel defining a ridge extending substantially perpendicular to said base portion.

3. The wire termination contact of claim 2 wherein said ridge is freed from said side panel at its extremity proximate said base portion to allow deformation of said offset portion independent of said base portion.

4. A multi-contact electrical connector for solderless termination of insulation covered electrical conductors comprising: an insulator housing having a mating end, a wire termination end and a plurality of elongated passages extending between said ends; a contact element within each of said channels; each of said contact elements being of thin sheet metal construction and including a mating portion and a wire termination portion, said wire termination portion comprising a pair of side wall sections and a base portion extending therebetween to define an elongated channel, at least one of said side wall sections having an integral offset formed inwardly into said channel to provide a contact jaw and a rounded transitional portion adjacent the free edge of said side wall section for rupturing the insulation and guiding the conductor into contact with said jaw during insertion, said rounded portion being forced by bending said thin sheet metal into a rounded blunt nose sufficiently rigid to rupture and separate the insulation from the conductor.

5. An electrical contact member of thin conductive sheet metal for solderless electrical connection with an insulation covered electrical conductor, comprising: an elongated channel portion with opposite side walls having at least one integral inwardly formed ridge portion extending vertically along at least one of said side walls and defining with a portion of the opposite side wall an upwardly open space for receiving said conductor, the upper portion of each such ridge being of a gradually increasing depth and defining a rounded blunt nose having a continuous thin sheet metal surface for separating the insulation from the conductor and guiding the conductor into said space, the lower portion of each such ridge being substantially parallel to the side walls to define a contact wiping surface for engaging said conductor in electrical contact with said element.

6. An electrical contact member as in claim 5 wherein the lower portion of each such ridge portion comprises a pair of wall sections each of which is integrally joined to the adjacent side wall along one vertical edge, said wall sections being joined together by a curved portion which provides said contact wiping surface, and wherein the upper portion of each of said ridges extends from said wall sections and curved portion and gradually recedes toward the respective side wall in a smooth continuous curve so as to provide a rounded lead-in portion for guiding a conductor into said space.

7. An insulation rupturing wire termination contact element for establishing and maintaining electrical contact with the conductive core of an insulated wire as the insulated wire is forced into the contact element, comprising a wire termination channel portion having side panels and a base portion of thin conductive sheet metal, each of said side panels having an integral offset portion formed inwardly into said channel to engage the conductive core of a wire inserted therein, said offset portions each having an end exposed toward the open side of said channel which end is formed by bending said sheet metal into a smoothly rounded blunt transitional configuration having sufficient rigidity for rupturing the insulation of a wire forced into said wire termination channel and for guiding the conductive core of such a wire into contact with the inwardly disposed surfaces of said offset portions, said offset portions being located in opposing relation to one another and defining a narrowed passageway for receiving a wire forced therebetween.

8. The wire termination contact of claim 7 wherein said offset portions each define contact faces extending substantially perpendicular to said base portion and wherein said side panels have slots transverse to said contact faces to separate the extremity of said contact faces proximate said base portion from said side panels.

9. The wire termination contact of claim 7 wherein said transitional portion of each of said offsets slopes into said channel from adjacent the free edge of the respective side panel to provide a gradually narrowing lead-in for guiding wires inserted into said channel.

* * * * *

UNITED STATES PATENT AND TRADEMARK OFFICE

CERTIFICATE OF CORRECTION

PATENT NO. : 4,050,760

DATED : September 27, 1977

INVENTOR(S) : Lawrence S. Cohen

It is certified that error appears in the above-identified patent and that said Letters Patent are hereby corrected as shown below:

Col. 1, line 17 - Before "parameters" insert --and performance--

Col. 1, line 33 - After "channel-like" insert --wire terminating electrical contact elements which hold--

Col. 3, line 26 - Change "smooth" to --smoothly--

Claim 4, Col. 5, line 49 - Change "forced" to --formed--

Signed and Sealed this

Seventh Day of March 1978

[SEAL]

Attest:

RUTH C. MASON
Attesting Officer

LUTRELLE F. PARKER
Acting Commissioner of Patents and Trademarks